United States Patent [19]

Mobley et al.

[11] Patent Number: 4,842,534

[45] Date of Patent: Jun. 27, 1989

[54] FUSE/BUS BAR ASSEMBLY

[75] Inventors: Dewey F. Mobley, Lake Orion; Robert G. Peterson, Canton; Robert S. Collar, Orchard Lake, all of Mich.

[73] Assignee: Interlock Corporation, Westland, Mich.

[21] Appl. No.: 257,531

[22] Filed: Oct. 14, 1988

[51] Int. Cl.[4] ..... H01R 25/16

[52] U.S. Cl. ..... 439/214; 439/622; 439/723; 337/191

[58] Field of Search ..... 439/621, 622, 721, 723, 439/724, 110, 214; 361/349, 355, 430–432; 337/191–193

[56] References Cited

U.S. PATENT DOCUMENTS

| | | | |
|---|---|---|---|
| 4,097,109 | 6/1978 | Cross | 439/622 |
| 4,221,456 | 9/1980 | Cairns et al. | 439/723 |
| 4,432,594 | 2/1984 | Daggett | 439/723 |
| 4,599,679 | 7/1986 | Baader | 361/355 |
| 4,722,701 | 2/1988 | Bradt | 439/724 |

*Primary Examiner*—Gary F. Paumen

*Attorney, Agent, or Firm*—Harness, Dickey & Pierce

[57] ABSTRACT

A fuse/bus bar assembly for use in automotive applications has a one-piece bus bar member of highly conductive material, a fixed terminal mounted on the bus bar, and a discrete terminal spaced from the fixed terminal, and a fuse plug connecting the discrete terminal with the fixed terminal mounted on the bus bar, the fuse plug having two legs, one of the legs inserted in the fixed terminal and the other of the legs inserted into the discrete terminal to fusibly connect the discrete terminal electrically to the bus bar. The fuse/bus bar assembly is made of two materials having differing thicknesses. The bus member is made from an elongated metal plate and the fixed terminal is made from a highly conductive metal strip. The fixed terminals are fastened to the bus bar by conventional means such as staking.

4 Claims, 3 Drawing Sheets

FUSE/BUS BAR ASSEMBLY

BACKGROUND AND SUMMARY OF THE INVENTION

This invention relates generally to electrical bus bars and more particularly to a fabricated fuse/bus bar assembly having separate fixed terminals on the bus bar for connection to a pluggable fuse.

Electrical bus bars having integral fuse connectors are in common use in appliances, automobiles etc. and are an essential electrical safety component in many products. These terminal and bus bar components are usually stamped from a single piece of highly conductive material such as a copper alloy metal. The terminals are then formed by bending portions of the stamped metal into the appropriate shape. This type of construction is disadvantaged in that the current capacity and heat dissipation characteristics of the bus bar is limited by the thickness and composition of the material used to fabricate the terminal.

The design requirements for a connector terminal and a bus bar differ substantially. A connector terminal is required to be rigid yet flexible and has a complex configuration best formed from thin sheet metal stock. In contrast, a bus bar needs to be stiff and must carry relatively high current loads. In addition, the thermal conductivity in a bus bar should be high for adequate heat dissipation. Because the current load through each connector is less than the current load through the bus bar, the heat dissipation characteristics of the connector material are not as important as in the selection of the bus bar material.

Accordingly, it is an object of the present invention to provide a fuse/bus bar assembly that can utilize a bus bar of various thicknesses and compositions as the current requirements demand, while utilizing other materials optimized for the fabrication of terminals.

It is another object of the present invention to provide a fuse/bus bar assembly capable of improved current carrying capacity by acting as an effective heat sink for resistive heat load dissipation.

A fuse/bus bar assembly according to the present invention for use typically in an automotive vehicle comprises a one-piece bus bar member of highly conductive material such as a copper alloy having a bus portion and a terminal attaching portion bent at an angle from the bus portion. Attached to the terminal attaching portion, by staking, riveting, or other attachment means, is a metal strip having a terminal formed at each end thereof. A plurality of the metal strips may be attached to the terminal attaching portion forming a series of pairs of the terminals spaced apart along the terminal attaching portion of the bus bar.

The connection between the strip and the terminal attaching portion of the bus bar provides a highly conductive electrical path between the fixed terminals and the bus bar to minimize resistive heating at the transition.

The fixed terminals formed from the metal strips may be male or female terminals for use with a fuse plug having legs of corresponding mating design. If the fuse plug has male terminals, one leg of the fuse plug is inserted into the fixed female terminal attached to the terminal attaching portion. The other leg of the fuse plug is inserted into a discrete female terminal attached to a wire leading to an external circuit load. The fuse/- bus bar assembly may be mounted within a plastic connector housing which then is bolted to the vehicle.

The result is a fuse/bus bar that can accommodate terminals formed from metal strips of differing thicknesses and materials depending upon the current capacity required for the individual circuit. The bus bar can be of different thickness or material composition to provide the required current carrying capacity and provide adequate heat dissipation for the entire circuit system. Thus the fuse/bus bar assembly of the present invention provides increased flexibility in power distribution design.

Further objects, features and advantages of the invention will become apparent from a consideration of the following description and the appended claims when taken in connection with the accompanying drawing.

DETAILED DESCRIPTION OF THE INVENTION

Figure 1:
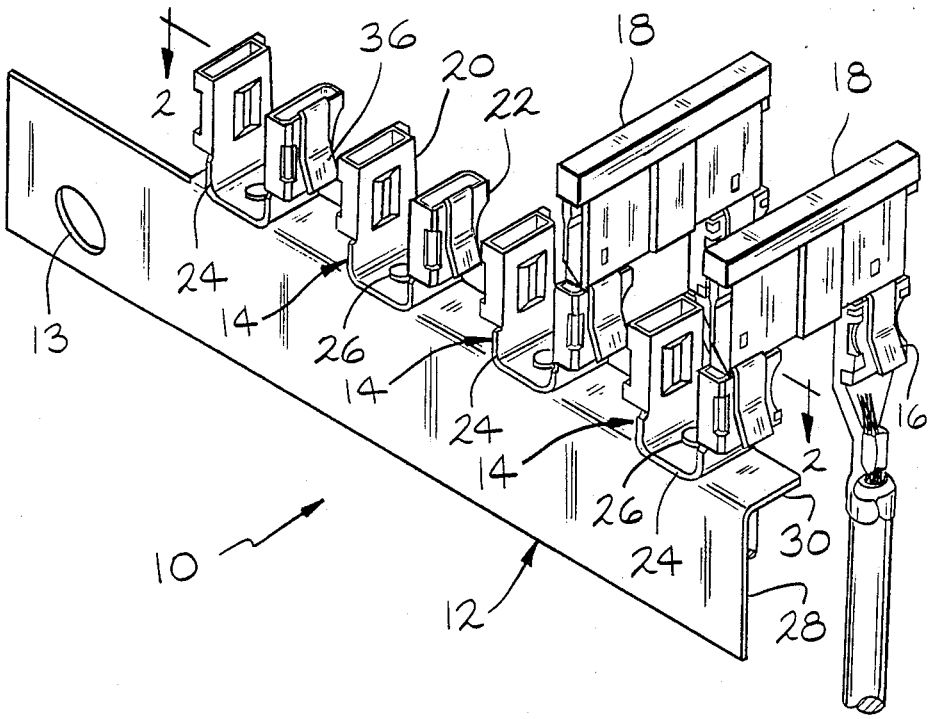
FIG. 1 is a perspective view of the fuse/bus bar assembly according to the present invention showing a pair of fuse plugs connected between the bus bar and discrete terminals.

Turning now to the drawing, the fuse/bus bar assembly according to the present invention, indicated generally at 10, is illustrated in the perspective view of FIG. 1. The fuse/bus bar assembly 10 comprises bus bar member 12 shaped from an elongated metal plate of highly conductive material such as a copper alloy. Attached to bus bar member 12 are a plurality of spaced apart fixed terminal members 14 which are in turn connected to discrete terminals 16 by a fuse plug 18 having male legs. An electrical power source may be connected to one end of bus bar 12 via a lug bolt (not shown) through hole 13.

As shown in FIG. 1, the fixed terminal members 14 each include a pair of fixed female terminals 20 and 22 formed from a conductive metal strip 24 which is joined by a fastening means 26 to bus bar member 12. Bus bar member 12 is formed from a flat plate of highly conductive metal alloy and has a bus portion 28 and a terminal attaching portion 30 bent at a right angle to bus portion 28.

Figure 2:
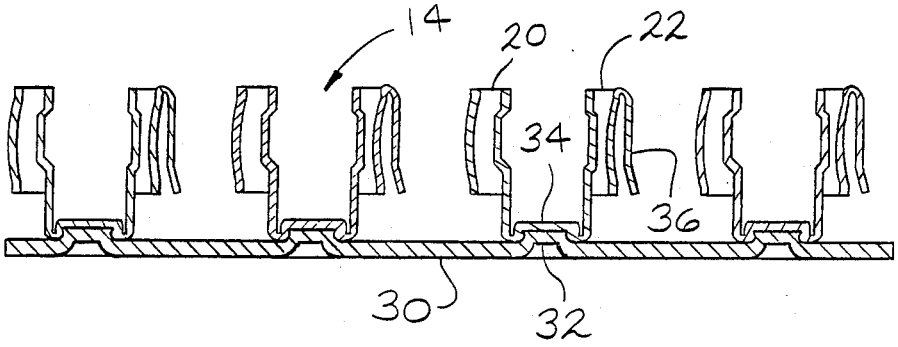
FIG. 2 is a sectional view of the fuse/bus bar assembly taken along the line 2—2 in FIG. 1.

As shown in FIG. 2, fixed terminal members 14 are attached to terminal attaching portion 30 via the fastening means 26 comprising staking portion 32 projecting upward into and engaging receiving portion 34 in conductive metal strip 24. Staking portion 32 and receiving portion 34 cooperate to retain fixed terminal members 14 on terminal attaching portion 30 together in solid metal to metal contact with minimal electrical resistance between them ensuring a low resistance connection.

Fixed terminal members 14 may also be secured to terminal attaching portion 30 by spot welding, riveting, or other conventional fastening means. Staking is, however, the preferred method of attachment in the embodiment shown.

Figure 3:
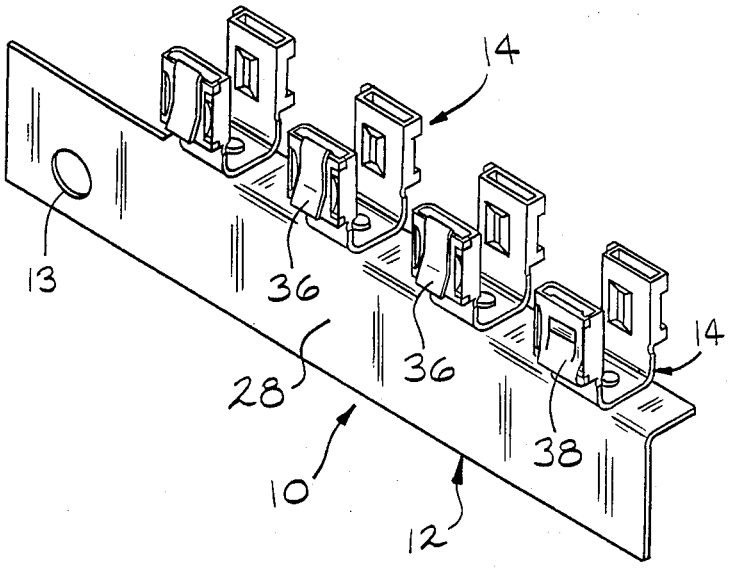
FIG. 3 is a perspective view of an alternative embodiment of the fuse/bus bar assembly of the present invention.

In FIGS. 1 through 3, each of the terminal members 14 has a flap 36 which is used to secure the terminal members 14 in place within an insulative plastic housing (not shown). Alternatively, the terminal members may be formed with a cut out portion 38 as shown in one of the terminal members 14 in FIG. 3. Cut out 38, in this case, would engage a corresponding shoulder projecting from the plastic body in which the fuse/bus bar assembly is mounted. Terminal members 14 with the variation of a slot or cut out 38 is shown in FIG. 3 merely to illustrate the various terminal configurations possible and within the scope of the present invention.

The fixed terminals and the bus bar are preferably stamped from separate flat stock metal materials. The fixed terminals may therefore be of a different thickness and/or have different material characteristics than the bus bar member 12. This feature permits the use of a thicker bus bar material which can carry the large current needed to supply all of the individual circuit requirements through the fixed terminal members 20 and 22 while operating at an acceptably low temperature.

The current capacity in the assembly according to the present invention is greatly increased over conventional bus bar arrangements. The fuse/bus bar assembly according to the present invention, for a given current capacity, also operates at a significantly lower thermal temperature than conventional bus bar configurations.

The invention has been described above in an illustrative manner and it is to be understood that the terminology that has been used is intended to be in the nature of words or description rather than of limitation. Obviously many modifications and variations of the present invention are possible in light of the above teachings. For example, the fixed terminals may be male tab terminals and the fuse plug may have corresponding female terminal legs. Also single or multiple terminals may be formed on each terminal member fixed to the bus bar. It is therefore to be understood that in the scope of the appended claims, the invention may be practiced otherwise than as specifically described.

What is claimed is:

1. A fuse/bus bar assembly comprising:

a one piece bus bar member of highly conductive material;

at least one fixed female terminal mounted on said bus bar member for mating connection to a leg of a fuse plug having two flat legs; and at least one discrete female terminal arranged in a predetermined spaced relation with said fixed terminal for mating connection to the other leg of said fuse plug to fusably connect said discrete terminal electrically to said bus bar member.

2. A fuse/bus bar assembly comprising:

a one piece bus bar member of highly conductive material;

a plurality of pairs of fixed female terminal mounted to said bus bar member for mating connection to a leg of a fuse plug having two legs, each of said pairs of terminals being jointed together by an elongated highly conductive metal strip, and fastening means for fastening said strip to said bus bar member; and at least one discrete terminal arranged in a predetermined spaced relation with said fixed terminal for mating connection to the other leg of said fuse plug to fusably connect said discrete terminal electrically to said bus bar member.

3. The fuse/bus bar assembly according to claim 2 wherein said bus bar member is an elongated metal plate having a bus portion and a terminal attaching portion bent at an angle from said bus portion, said metal strip between said terminals secured to said terminal attaching portion by said fastening means, said means providing a highly conductive path between said fixed terminals and said bus bar whereby resistive heating in said bus bar member due to current passage therethrough is minimized.

4. The fuse/bus bar assembly according to claim 3 wherein said fastening means comprises a staking portion on said terminal mounting portion of said bus bar member and a receiving portion on said strip for receiving said staking portion, said staking portion projecting upward within said receiving portion and cooperating with said receiving portion to retain said strip and said terminal attaching portion together in metal to metal contact to provide a high current capacity connection between said strip and said bus bar member.

* * * * *